US006065770A

United States Patent [19]

Hansen et al.

[11] Patent Number: 6,065,770

[45] Date of Patent: May 23, 2000

[54] SNOWBOARD BINDING

[76] Inventors: Reinhard Hansen, Zaunergasse 15b, A-5020 Salzburg; Werner Jettmar, Markt 17, A-7121 Weiden am See, both of Austria

[21] Appl. No.: 09/149,573

[22] Filed: Sep. 8, 1998

[51] Int. Cl.[7] ..... A63C 9/02; A63C 9/00

[52] U.S. Cl. ..... 280/617; 280/618; 280/613; 280/14.2; 280/621; 280/623

[58] Field of Search ..... 280/607, 619, 280/618, 617, 621, 623, 14.2, 11.36, 613; 36/117.1, 117.7, 117.8, 117.9, 118.6

[56] References Cited

U.S. PATENT DOCUMENTS

| | | | |
|---|---|---|---|
| 4,880,251 | 11/1989 | Wulf et al. | 280/613 |
| 4,887,833 | 12/1989 | Bailey | 280/615 |
| 4,949,479 | 8/1990 | Ottieri | 36/117 |
| 5,261,689 | 11/1993 | Carpenter et al. | 280/618 |
| 5,556,123 | 9/1996 | Fournier | 280/607 |

FOREIGN PATENT DOCUMENTS

| | | |
|---|---|---|
| 787 512 A1 | 8/1997 | European Pat. Off. . |
| 44 16 023 C1 | 10/1995 | Germany . |

*Primary Examiner*—Lanna Mai
*Assistant Examiner*—Hau Phan
*Attorney, Agent, or Firm*—Senniger, Powers, Leavitt & Roedel

[57] ABSTRACT

A snowboard binding for fastening a snowboard boot to a snowboard includes a baseplate adapted to be mounted on the snowboard and side walls projecting vertically upward. An instep element is mounted over the baseplate and adapted to reach over the instep of the snowboard boot. A tread element is coupled to the instep element and movable downward a displacement distance for moving the instep element into a closed position. Flexible tensile elements couple the tread element to the instep element and the flexible tensile elements are mounted on respective sides of the instep element. Deflection elements engage each of the tensile elements. Each of the deflection elements are positioned above the baseplate a distance at least as great as the displacement distance.

20 Claims, 10 Drawing Sheets

SNOWBOARD BINDING

BACKGROUND OF THE INVENTION

The invention pertains to a snowboard binding according to the preamble of Claim 1. Such a snowboard binding is known from DE 44 16 023 C1. This binding possesses a flat baseplate that can be fastened to the snowboard, from which baseplate a lateral side wall projects at either side. Roughly in the middle of each lateral side wall, a pivot lever is seated that can be pivoted about the transverse axis of the binding. The pivot levers of the two sides are coupled together by a tread element. Fastened to each of the two pivot levers is one end of an instep belt that reaches over the instep of a snowboard boot and holds it in place in the closed position of the binding. An additional lever mechanism that is connected to a toe element reaching over the front foot area of the snowboard boot is fastened on each of the pivot levers eccentrically to the pivot axis of the pivot levers. In the open position of the binding the tread element is in an upper limit position. In order to close the binding, the boot is introduced between the tread element and the instep and toe element, wherein roughly the middle of the sole comes into contact with the tread element. By pressing the sole down, the tread element and the pivot levers are pivoted downwards about the axis of the pivot lever, so that, in principle, the instep element is moved on a circular path downwards and backwards (in relation to the longitudinal axis of the boot). Via the lever mechanism, the toe element is also pivoted downwards and backwards. The space between the point of the tread element that first comes into contact with the boot sole in the open position and the inside of the instep element is essentially constant, since both are pivoted essentially only about the axis of the pivot lever. Thus the "opening width" of the binding in the entry position is relatively small. There is the risk that the length of the instep element is then adjusted too large for comfortable entry and the binding is too loose in the closed position. Since the tread element is placed roughly in the center of the binding but the largest stepping force are produced only by the heel of the foot, it is possible only with difficulty to exert the force necessary for strong tightening and closing of the binding.

U.S. Pat. No. 5,556,123 shows a snowboard binding with a base part, from which lateral side walls project up vertically on each side, a one-piece instep element, and a heel element fastened so as to pivot to the base part. The instep element is fastened by tensioning cables that pass through the lateral side walls. The tension cables are guided over deflection elements in the vicinity of the bottom of the base part and run up to the rear side of the heel element. In order to enter the binding, the heel element is pivoted backwards and the boot can be introduced between the lateral side walls and the below the instep element. In order to close the binding, the heel element is pivoted vertically upwards, whereby the tensioning cables become tensioned and the heel element is essentially pulled downwards.

Automatic closing by pressing the boot down (step-in function) is not provided in this binding.

EP 0 787 512 A1 shows a snowboard binding in which, at the toe end of a binding plate is arranged a pivot part that can be pivoted about a transverse axis and to which a length-adjustable instep belt and a length-adjustable heel belt are fastened. A heel element standing vertically is placed at the other end of the binding plate. In order to enter the binding, the pivot part is pivoted at an incline upwards so that the boot can be introduced. In closing the binding, the pivot part is pivoted downwards and the boot heel slides down on the heel element. Subsequently, the pivot part is pivoted even further downwards and the instep element is tightened by ratchet levers that connect the instep element to the baseplate.

SUMMARY OF THE INVENTION

The problem of the invention is to improve the snowboard binding of the initially mentioned type in the sense that, with a simple structure, it has a large opening width for introducing the boot and holds it in place in the closed position.

This problem is solved by the characteristics specified in Claim 1. Favorable configuration and refinement of the invention can be derived from the subordinate claims.

The basic principle of the invention consists in connecting the instep element via a flexible tensile element, such as a cable which is guided over at least one deflection element, to the tread element. The deflection element is arranged at least the displacement distance of a tread element above the baseplate. The tread element is pressed by the user essentially vertically downwards to the baseplate. By this arrangement between instep element, deflection element and tread element, the distance between the instep element and the tread element changes. This spacing is greater in the open position of the binding than in the closed position. Thus the opening width for introduction of the boot, which is determined by aforesaid spacing, can be relatively large, so that the boot can be inserted comfortably into the binding. Since this spacing decreases upon closure of the binding, the instep element is pressed against the instep of the boot and the binding is firmly closed. The ends of the tensile elements attached to the instep element lie only slightly higher or even at the same height as the deflection element, so that, upon pressing the tread element downwards, the instep element is drawn primarily backwards in the direction of the heel part of the binding and presses the boot firmly against a heel element of the binding (generally also called a "high back") at the same time. The inside contour of the heel element can then be fitted to the contour of the back side of the boot, which additionally improves the support of the binding.

Preferably the toe element of the one-piece instep element is also connected to the basic element of the binding via flexible tensile elements, such as a cable, a strap, a toothed belt or a pivotably seated connection element. Since the one-piece instep element is relatively rigid on its own, these front tensile elements are bent such that even the toe area of the instep element is pressed backwards and somewhat downwards upon closure of the binding, so that a closure movement takes place even in the toe area and the boot is well held even in this area. Alternatively to a cable, a toothed belt articulated to the basic element and the instep element can also be provided.

In one embodiment, the tread element is guided in a sliding guide that runs essentially perpendicular to the snowboard that, upon pressing the boot down, the latter is moved by the friction between sole and tread element somewhat backwards in the direction towards the heel element. The tread element is guided here in an elevated heel area of the lateral side walls, i.e., the user steps onto the tread element with the part of the sole on the heel side and can thus exert the forces necessary for closing the binding without effort. The length of the sliding guide determines the displacement distance. In practice, it will be on the order of 6 to 9 cm. Correspondingly, the elevated heel area of the lateral side walls is at least as high and thereby additionally gives the boot a better side support in the heel area. The deflection element is arranged above the sliding guide and can be displaced for fine adjustment of the binding, preferably in the horizontal direction.

In order to hold the binding in the closed position, a locking element is provided in this embodiment which projects in one variant of the invention into the area of the sliding guide, has a leading incline facing upwards and is prestressed by a spring. By pressing the tread element downwards, the locking element is moved out of the area of the sliding guide due to the leading inclination, which may take place in either a pivoting or a linear motion. The tread element thus slides past the locking element, the latter then snapping back into the closed position due to the aforesaid spring and serving as a catch for the tread element. To open the binding the locking element is moved by a tensile element, an opening belt for instance, against the force of the spring and the tread element can slide upwards in the sliding guide, thereby the binding is released for the opening motion.

According to another variant, the catching or locking can be accomplished by the presence on the tensile element of a thickened part, such as a pressed-on ball, which slides past a spring-tensioned detent pawl that then snaps back and catches the tensile element at the ball.

The effective length of the tensile element is preferably adjustable. In order to improve the stepping into the binding, at least one pivoting support element is arranged on the heel part, which provides better support in that it is fitted to the contour of the boot.

In an additional embodiment the tread element and the tensile element are formed by a cable, where the respective cable passes through a hole provided in the lateral side walls and the cable ends are connected to the instep element. The cable section lying between the two lateral side walls form the tread element and is pressed downwards by the boot heel in order to close the binding. In order to adjust the closing position of the binding, that is, the closing position of the instep element, a length adjustment device such as a Velcro strip joined to one end of the cable can be provided on the instep element. In order to maintain the closed position, tooth belts engaging in catch device are provided, through which the instep element is connected to the lateral side walls. Also provided is a tensile element extending over the instep element and with its ends connected to opening elements of the catch devices. By pulling on the tensile element, the catch devices can be unlocked, which enables the opening of the binding.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 2:
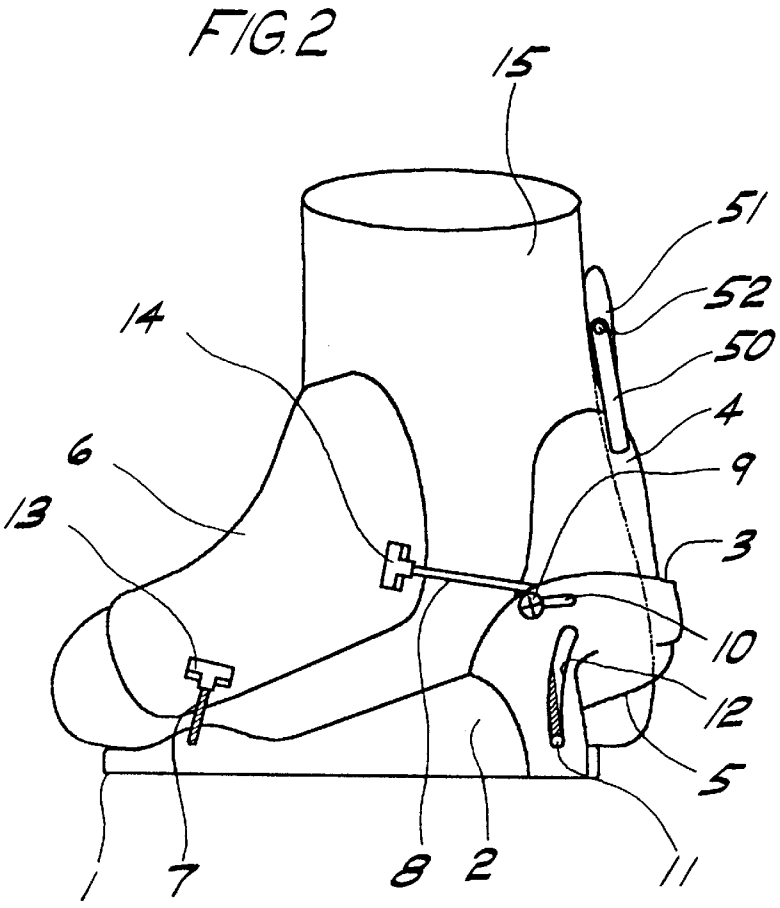
FIG. 2 is a schematic sketch of the snowboard binding in a side view in the closed position.
Figure 1:
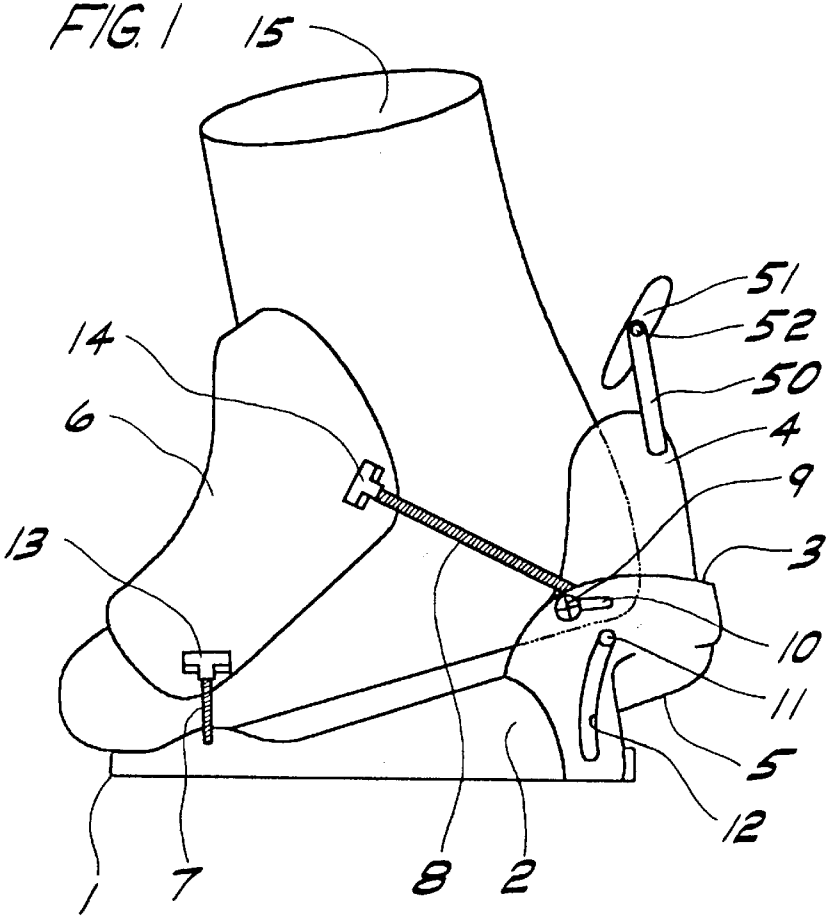
FIG. 1 is a schematic sketch of the snowboard binding in a side view in the open position.

FIGS. 1 and 2 show the snowboard binding in a schematic side view in the open and closed position. The snowboard binding has a flat baseplate 1 that can be fastened to the top side of the snowboard binding. From the baseplate, lateral side walls 2 project vertically on both sides, the two lateral side walls featuring an elevated heel part 3 and the two elevated heel parts 3 being connected together (cf. FIG. 3*a*). A heel support 4, on which the back side of the boot is supported in the vicinity of the shin bone, is placed on this elevated heel part 3. The heel support 4 can be placed immediately on the heel part 3. For transport purposes, however, it can be pivoted forwards to the toe area of the binding. The lower part of the heel part 3 facing towards the baseplate 1 and the section connecting the two heel parts has a spacing from the baseplate, so that the binding in this area has an opening 5 from which the heel of the snowboard boot escapes (cf. FIG. 2).

On the heel part 3, at least one, and preferably two, support elements 51,51' supporting the boot shank (cf. FIG. 3*a*) are arranged and fastened to a retainer strap 50 that extends essentially parallel to the longitudinal direction of the boot shaft and on which the support elements, 51,51' are seated so as to pivot about a transverse axis 52. Because of the pivoting seating, their pivot position automatically adapts to the instantaneous position and the contour of the boot 15, whereby stepping into the binding as well as stepping out is facilitated and thus becomes more comfortable. With a closed binding, the support elements 51,51' are situated on the outside on the boot shank and thereby support the boot 15, wherein the retainer strap 50 is possibly elastic to a certain extent. The retainer strap 50 can be inseparably joined to the heel part 4. Alternatively, it is also possible to provide a cutout in the heel part 4, into which the retainer strap 50 can be inserted or engaged so that, for instance, it can be removed for transport. It is also possible for the heel part 4 to end at the height of the connection point with the retainer strap 50, the support element 51 being given a concave shape as seen from above, and thereby supporting the boot shaft on the heel side as well as laterally. The binding also features a one-piece instep element 6 that covers the front part of the snowboard shank 15 in the area of the instep and holds the boot in place in the closest position in cooperation with the heel element 4, the baseplate 1 and the lateral side walls 2. The instep element is fastened by a total of four flexible tensile elements, such as steel cables 7,7',8',8' (FIG. 3), to the lateral side walls. In the toe area, the tensile elements are relatively short. In the instep area, on the other hand, the tensile elements are longer. The tensile elements are fastened in the rear area on the heel side and close to the baseplate to the instep element 6 and run from there via a deflection element 9 to a tread element 11, to which they are fastened. The deflection element 9 is arranged in the upper area of the elevated heel part 3 and is situated above the baseplate 1 by at least the displacement distance of the tread element 11. The tread element 11 is a rod running transverse to the longitudinal axis of the binding and guided here in slot-like sliding guides 12 on both elevated heel parts 3. The sliding guides 12 run essentially vertical to the baseplate 1, but they can also, as shown in FIGS. 1 and 2, be slightly curved in an arc shape or inclined to the rear, so that, when being pressed down, the tread element also has a slight motion component to the rear, i.e., towards the heel side of the binding. The sliding guide can also be omitted, so that the tread element hangs freely from the tensile element like a "swing" and enters only shortly before reaching the closed position into a V-shaped guide that ensures a positioning in relation to the catch device.

The deflection element is arranged above the sliding guide. It can be displaced in a slot 10 in the elevated side part 3 in order to adjust its position. The effective length of the tensile elements 7 and 8 can be finally adjusted by way of fastening elements 13 and 14, respectively, with which the tensile elements are fastened instep element 6, as is explained in greater detail in conjunction with FIG. 4. In the open position of FIG. 1, the tread element is in its upper limit position. Due to a certain inherent stiffness of the tensile elements 7 and 8, the instep element 6 moves forwards and upwards. The boot 15 can be introduced at an incline from above between the instep element 6, the heel element 4, and the tread element 11. When the heel of the boot touches the tread element 11, then, with further pressing downwards, the tread element 11 is displaced along sliding guide 12 essentially downwards and entrains the tensile element 8 guided over the deflection roller 9. Because of the deflection element 9, the motion component acting on the instep element 6, or, more precisely, on the fastening element 14, is directed backwards in the direction of heel element 4, while the motion component directed downwards towards the baseplate is comparatively smaller. The instep element is thus predominantly drawn backwards in the direction of the heel element 4, whereby the boot 15 is pressed firmly against the heel element 4, where, because of its bent contour against the correspondingly fitted contour of the heel element 4, the backside of the boot also finds a certain support against being pulled out upwards. Since the one-piece instep element has a certain inherent stiffness, the toe-side tensile element 7 is moved backwards in the described motion and simultaneously pulled somewhat downward, so that the instep element 6 is also pressed downwards in the front and closes well there.

It should furthermore be particularly emphasized that, because of the relative arrangement between the fastening element 14, and the deflection element 9 and the tread element 11 guided in the sliding guide 12, the spacing between the fastening element 14 and the tread element 11, which ultimately determines the "opening width" of the binding, namely the spacing between the instep element 6 and the tread element 11, is greater in the opening position than in the closed position. Thus one has a relatively large opening width when stepping into the binding, which permits a comfortable introduction of the boot and secure support in the closed position. It should also be emphasized that in the closed position the tension direction of the tensile element 8 is directed essentially backwards in the direction of the heel element 4 and not downwards, as in the prior art.

Figure 3A:
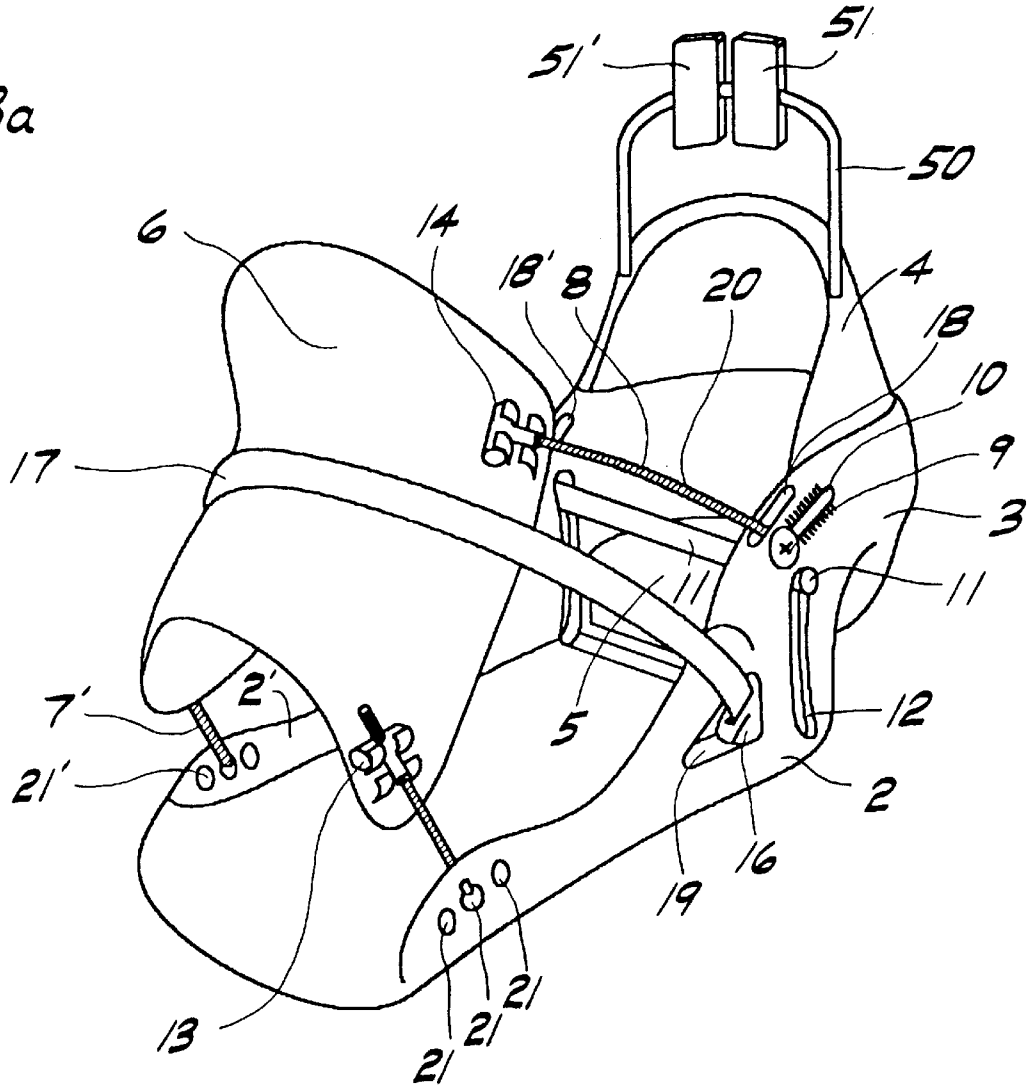
FIG. 3 is a perspective representation of the snowboard binding in the open position with an opening belt arranged on the instep side.
FIG. 3*b* shows a snowboard binding with an opening belt arranged on the heel side.

FIG. 3*a* shows a perspective representation of the binding in the open position. It is better recognizable here that the tread element 11 is a rod extending transverse to the longitudinal axis of the binding from one lateral side wall 2 to the other lateral side wall 2'. One also recognizes a locking element 16 that is guided in each lateral side wall 2 so as to be displaced or pivoted and, as described in greater detail in conjunction with FIGS. 6–9, brings about a catching in the closed position. An opening belt 17 is fastened to the locking element 16 and guided here over the instep element 6 and is operated manually by the snowboarder in order to step out of the binding.

Figure 5:
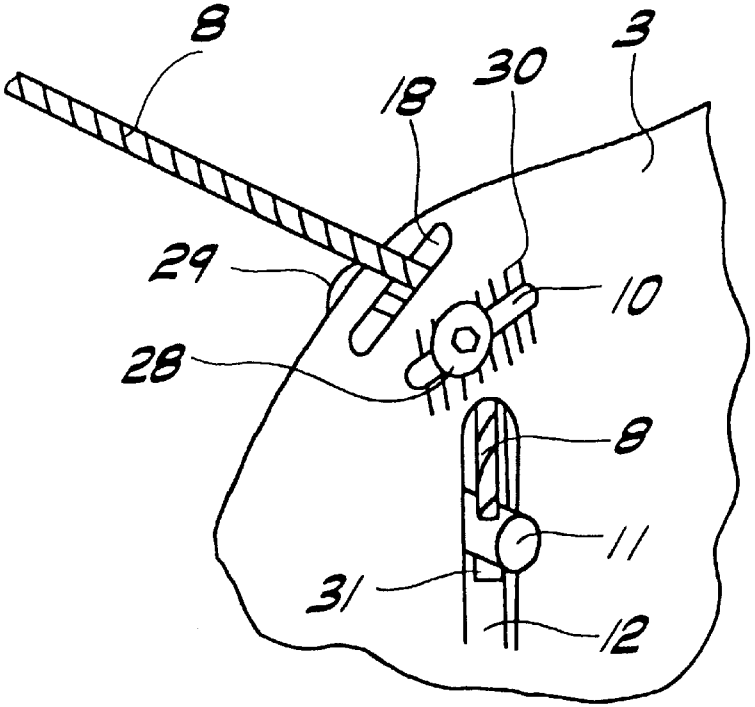
FIG. 5 is a detail view of the rear tensile element, the deflection element, the tread element and sliding guide.

The lateral side walls 2 and the elevated heel part 3 are constructed here with double walls and have an opening 18 for connection with FIG. 5. The locking element is also guided on the inside of the lateral side walls, which likewise have an opening 19 for passage of the opening belt 17.

A recess 20 that accommodates the tread element 11 in the depressed position is provided in the bottom of the baseplate 1, so that the sole of the boot lies completely in the plane of the baseplate 1.

Finally, it can be recognized that the fastening of the toe-side tensile elements 7 and 7' to the associated lateral side walls 2 and 21 is accomplished via holes 21,21' in the lateral side walls, wherein several holes 21,21' arranged offset in the longitudinal direction of the binding are present in order to fit the position of the instep element to the boot size.

Figure 3B:
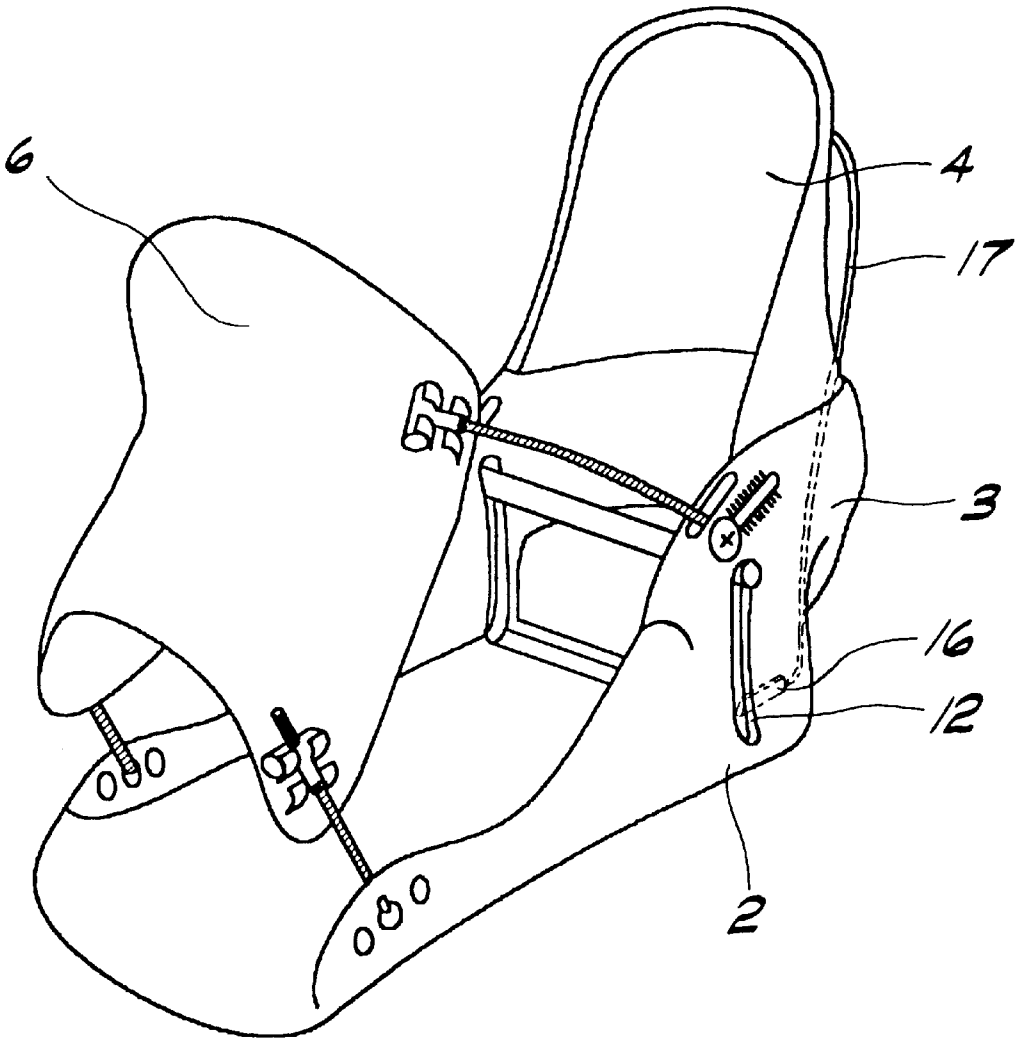

FIG. 3*b* shows an embodiment in which the opening belt 17 is arranged in part in the interior of the lateral side walls 2 or the heel support 3 and escapes to the exterior on their back side. There the opening belt can be suspended from the heel support 3, whereby it is held in place during snowboarding. Since the opening belt 17 arranged on the heel side reaches relatively far up, comfortable opening of the binding is possible. The opening belt 17 is connected to the locking element 16, which is arranged on the inside of the lateral side wall 2 and is therefore drawn in dash lines. The opening of the binding is accomplished by pulling on the opening belt 17, whereby in this embodiment the locking element 16 is pulled towards the boot heel, so that the tread element 12 can be pulled upwards in the illustrated "open position." Alternatively to the indicated arrangement, the opening belt 17 can be led around the heel support.

Figure 4:
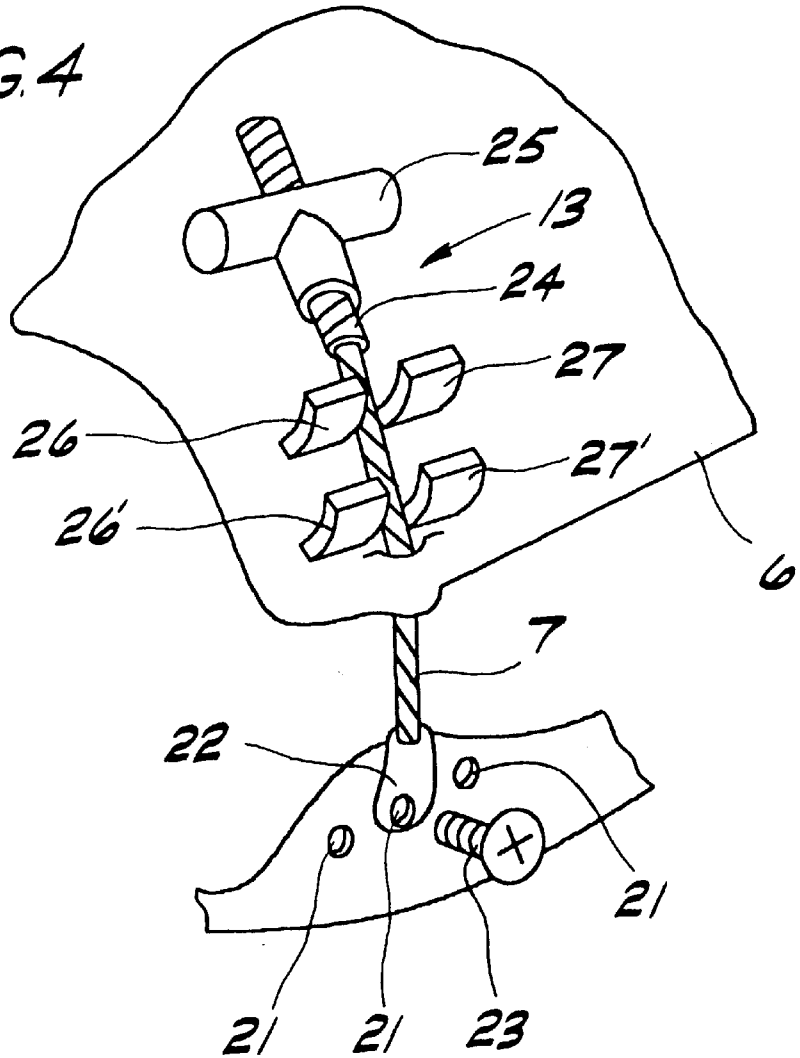
FIG. 4 is a detail view of the fastening of the toe-side tensile element to a lateral side wall and the instep element.

FIG. 4 shows the fastening of the toe-side tensile element 7 to the lateral side wall 2 (cf. FIG. 1) and the instep element 6. At the lower end of the tread element 7, an end piece 22 which has an opening that is flush with one of the holes 21 is fastened, pressed on, for instance. The fastening is accomplished by a screw 23. Fastened to the upper end of the tensile element 7 is a threaded sleeve 24 without outside threading, pressed on, for instance, or is soldered on. A T-piece with inside threading is screwed over the threaded sleeve 25. Two pairs of hooks 26,27 and 26',27' that form a free space between themselves for passage of the tensile element, the threaded sleeve, and one leg of the T-piece are arranged here on the instep element. The crossbar of the T-piece 25 is thus supported on the hooks 26,27 or 26',27'. Depending on the pair of hooks from which the T-piece is suspended, a stepped length adjustment is achieved. In addition, a fine adjustment of the effective length of the tensile element 7 can be performed by turning the T-piece 25 with respect to the threaded sleeve 24. The hooks are thus bent such that at least their upper side is fitted to the contour of the crossbar of the T-piece 25. The spacing of the pairs of hooks in the longitudinal direction of the tensile element 7 can be selected corresponding to the thickness of the crossbar of the T-piece 25 such that this crossbar, when supported on the lower pair of hooks 26',27', is also held in place by the lower side of the upper pair of hooks 26,27. The rear tensile elements 8 and 8' are also held in place in the same manner on the instep element 6.

Alternatively to the embodiment shown, the tensile element 7 can also be arranged inside the lateral side wall 2. It is also possible to shape the end piece 22 like a hook so that it can be suspended from the hole 21. The end piece 22 can also be provided with a thickened part and the hole 21 and has a slot-like section in which the thickened part can be inserted or engaged.

FIG. 5 shows an enlarged perspective representation of the binding in the area of the deflection element 9, which here is merely a bolt that is inserted through the double-walled heel piece 3 and deflects the tensile element 8. This bolt is guided in slots 10 on the two walls, wherein these slots 10 run horizontally or at an angle upwards. Thereby the position of the deflection element 9 can be adjusted. The deflection element is fastened by a screw 29 and a nut 28 with a washer to the heel part 3, wherein ribbing 30 can be provided in order to prevent an inadvertent displacement of the deflection element 9. It goes without saying that a roller free to rotate can be fastened to the bolt 9 as a deflection element, whereby the friction is reduced and, for a sufficiently large radius, it is also assured that the tensile element 8 is not bent. Arranged in the area below the deflection element 9 is the sliding guide 12 constructed as a slot, in which the tread element 11 is guided. The lower end of the tensile element 8 is fastened to the tread element 11, for instance, by being inserted through a hole of the deflection element 11 and secured by a nipple 31, a press sleeve or the like.

Alternatively to the embodiment shown, multiple deflection elements can also be provided, through which the tensile element 8 is guided.

Figure 7:
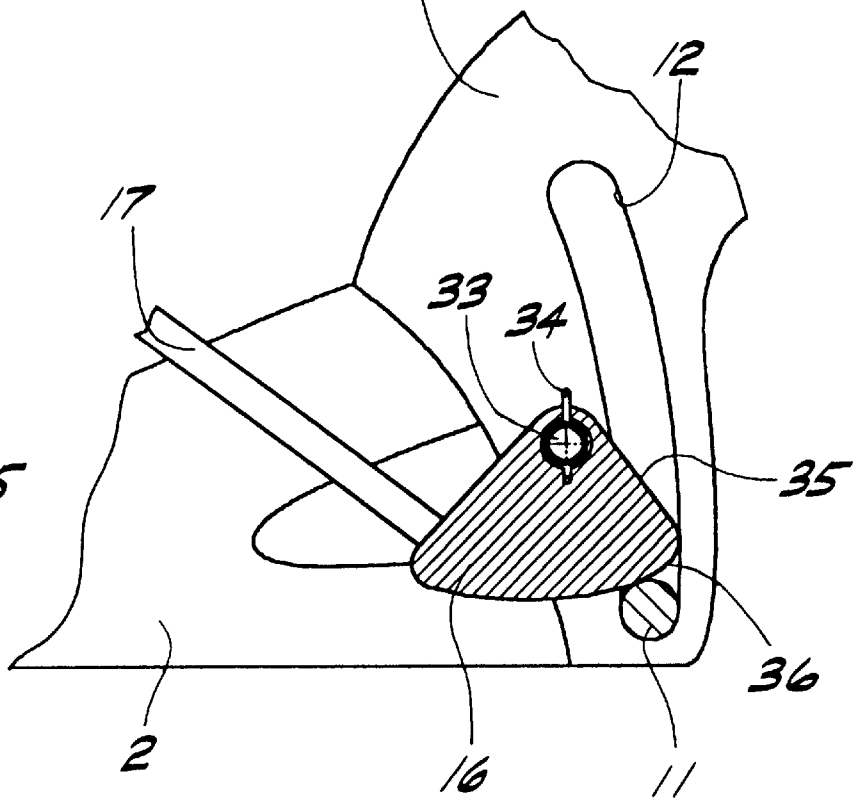
FIG. 7 is a side view of the locking mechanism of FIG. 6 in the closed position.
Figure 6:
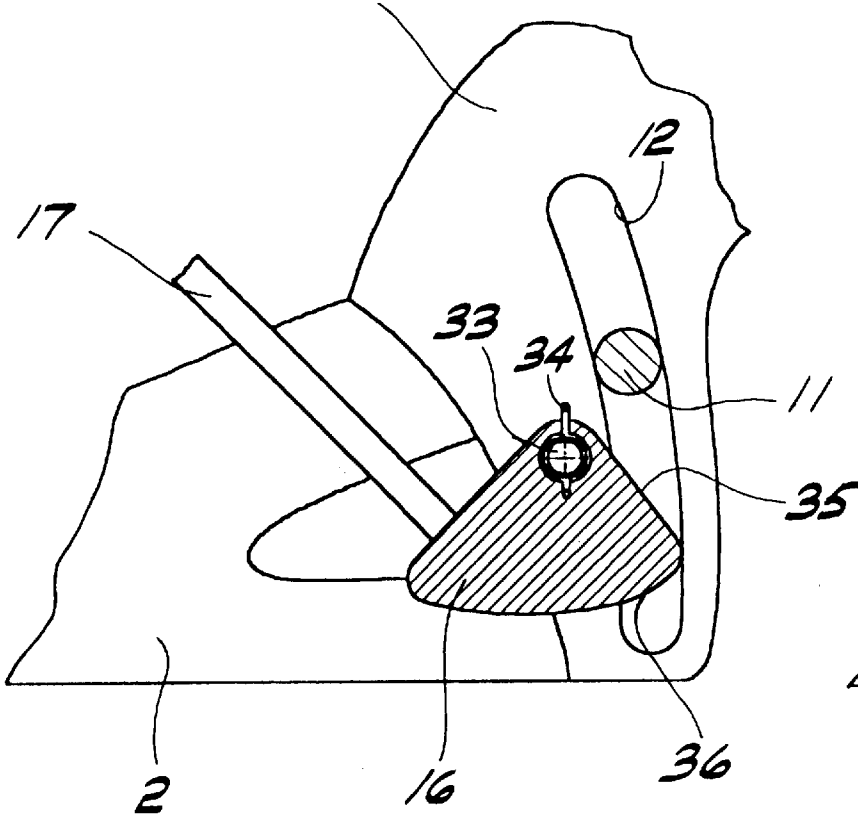
FIG. 6 is a side view of a locking mechanism in the open position of the binding.

FIGS. 6 and 7 show a first variant of a locking device, formed here by the locking element 16, which has roughly a triangular contour in a side view and can be pivoted about a shaft 33 arranged in the area of the tip of the triangle. The locking element penetrates the opening of the sliding guide 12 and has an incline 35, along which the tread element 11 slides when being pressed, and thus pivots the locking element 16 clockwise in the illustration of FIGS. 6 and 7. The locking element 16 pretensioned by a spring 34, supported on it, on the one hand, and on the lateral side wall, on the other, such that it projects into the sliding guide 12.

The lower side 36 of the locking element 16 is curved and serves as a locking surface for the tread element 11. As soon as this has moved past the incline 35, the locking element 16 snaps back because of the force of the spring 34, and the lower side 36 comes into contact with the tread element 11. Since the center line of the sliding guide 12 is eccentric to the shaft 33, a certain self-inhibition is obtained, which prevents an inadvertent opening of the locking element, even in case of forces directed upwards onto the tread element 11. This self-inhibition depends on the contour of the lower side 36, the area of the line of contact with the tread element 11 and on the coefficient of friction between these two elements. In order to enable a later opening of the binding, the radius of curvature of the lower side 36 in the area of the common line of contact with the tread element 11 must not be larger than the distance from the common line of contact to the shaft 33. By sufficient dimensioning of the spring 34, it can be assured that the locking remains secure for all forces that may occur.

To open the binding, the locking element 16 is pivoted clockwise by tension on the opening belt 17, whereby the tread element is released for a motion upwards along the sliding guide 12 and the binding can be opened.

Figure 8:
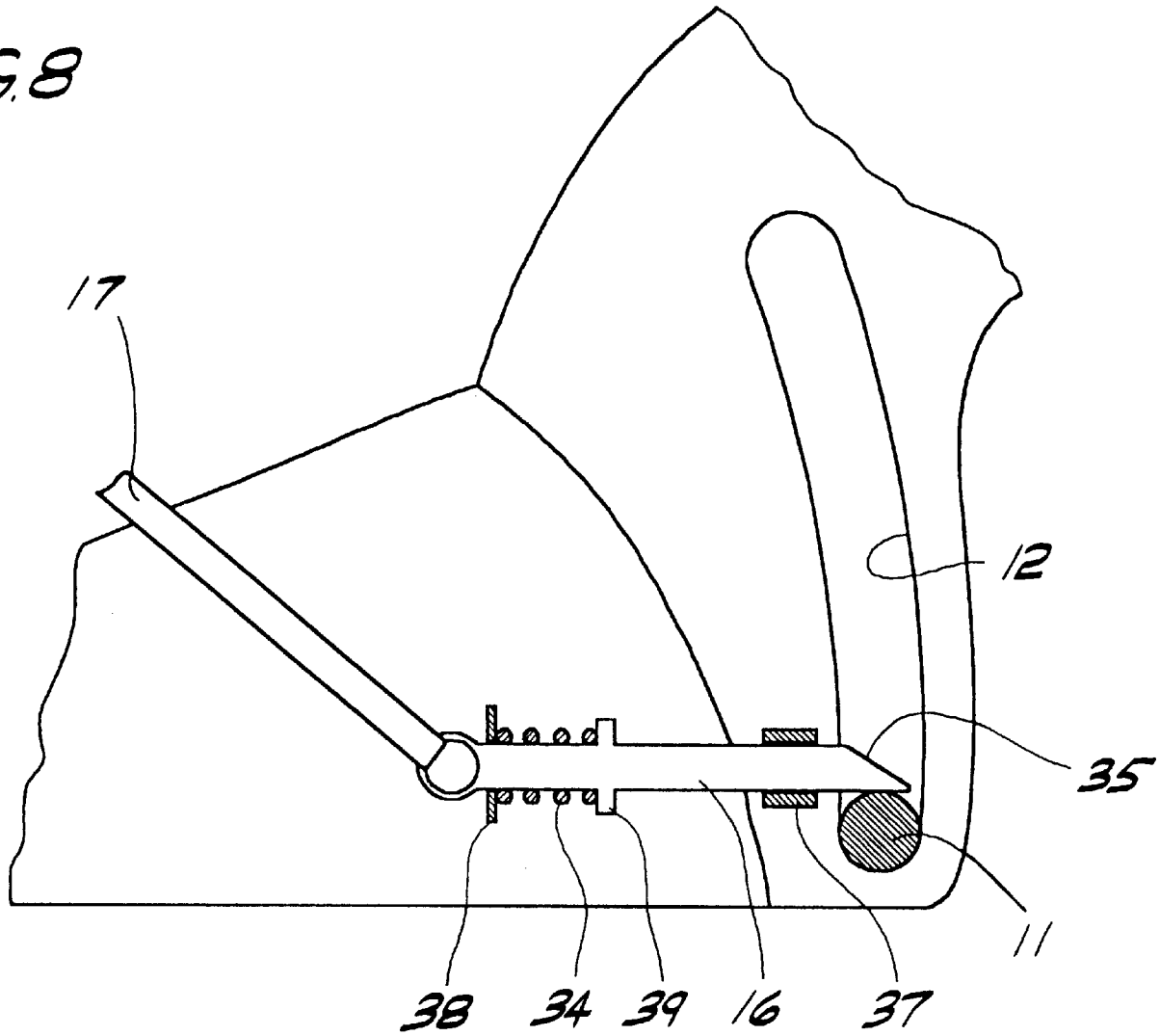
FIG. 8 is a side view of another variant of a locking device in the closed position.

FIG. 8 shows another variant of the locking wherein a bolt that can be displaced linearly in turn projects into the area of the sliding guide 12 and has a leading incline 35 directed upwards. This bolt is guided on the lateral side wall 2 so as to be displaced in bearings 37 and 38 and features a circumferential collar 39, on which the spring 34, constructed here as a spiral spring, is supported. The other end of the spring is supported on the bearing 38, so that the spring 34 presses the bolt into the area of the sliding guide 12. Here too, the locking element 16 is pressed out of the area of the sliding guide 12 upon pressing down the tread element 11, because of the leading incline 35, so that the tread element 11 can slide past. As soon as this has happened, the bolt is again pressed into the area of the sliding guide 12 due to the spring 34, and its lower side catches the tread element 11. At the other end of the locking element 16, the opening belt 17 is again fastened by, for instance, an eyelet. In this variant the locking is exclusively positive and does not depend on the strength of the spring 34.

Figure 9:
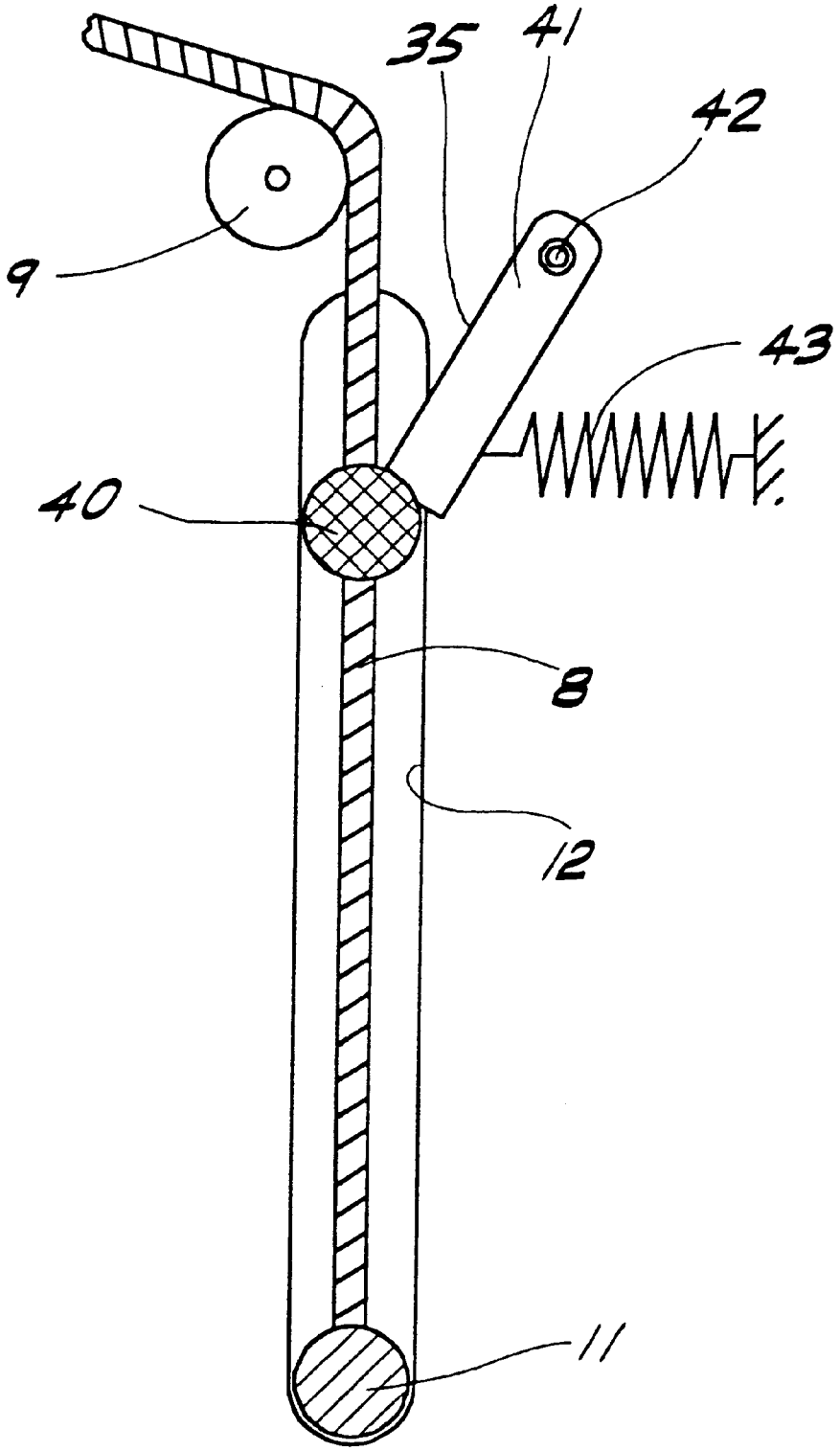
FIG. 9 shows a third variant of a locking device in the closed position.

FIG. 9 shows an additional variant of the locking element, in which the tread element 11 is not directly caught, but rather the tensile element 8. There is a thickened part 40 on the tensile element, in the form, for instance, of a pressed-on ball. As a locking element, a detent pawl 41 is provided here, which is seated so as to pivot on a shaft 42 and is pressed via a spring 34 into the area of the sliding guide 12. The detent pawl 41 is oriented at an incline downwards, so that it likewise forms a leading incline 35, on which the thickened part 40 can slide by and at the same time pivot the detent pawl 41 against the force of the spring 43. As soon as the thickened part 40 has moved past the detent pawl, the latter again pivots back and the thickened part 40 is supported on the free end of the detent pawl 41. In order to open the binding, the detent pawl is in turn pivoted by an opening belt, not shown, or some other tensile element against the force of the spring 43 out of the area of the sliding guide 12.

Figure 10A:
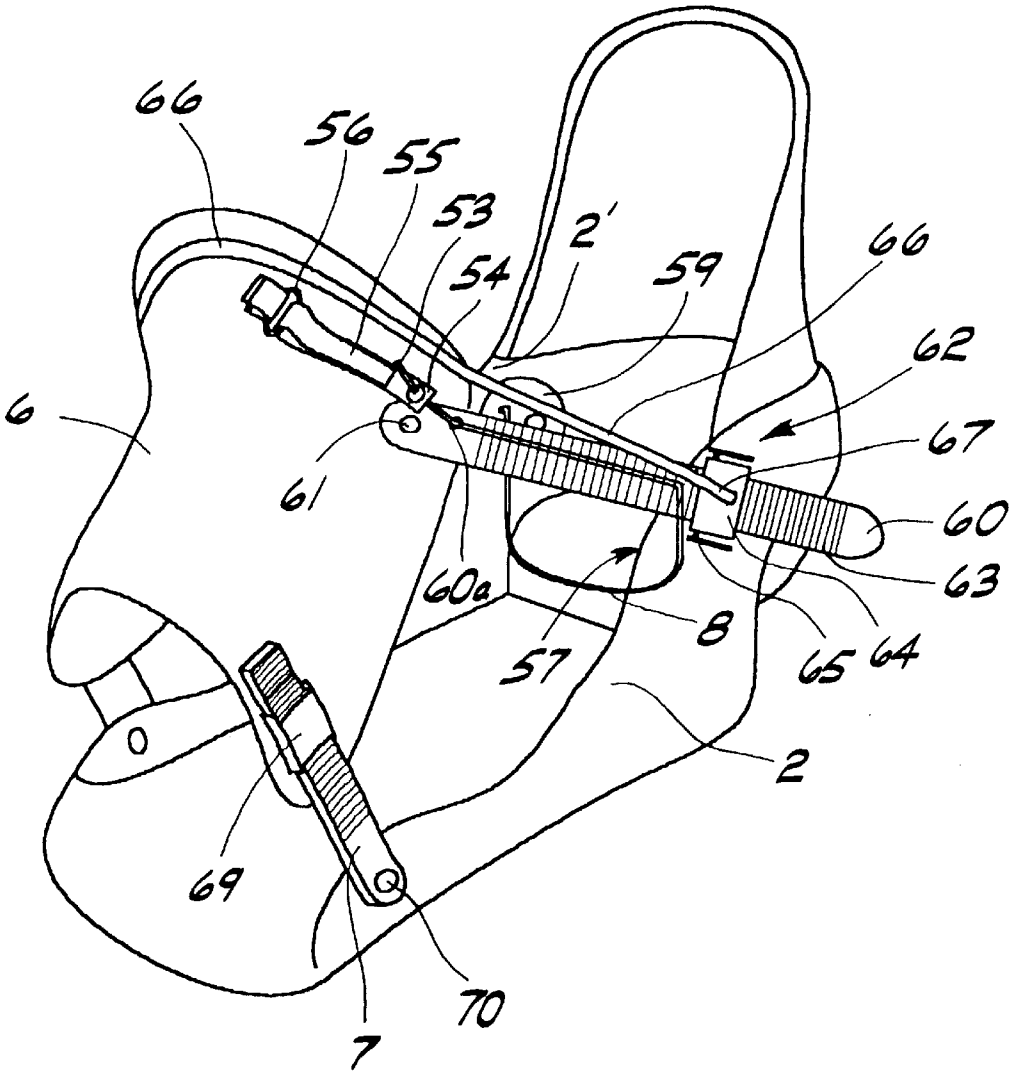
FIG. 10*a* shows an additional embodiment of the snowboard binding.
Figure 10B:
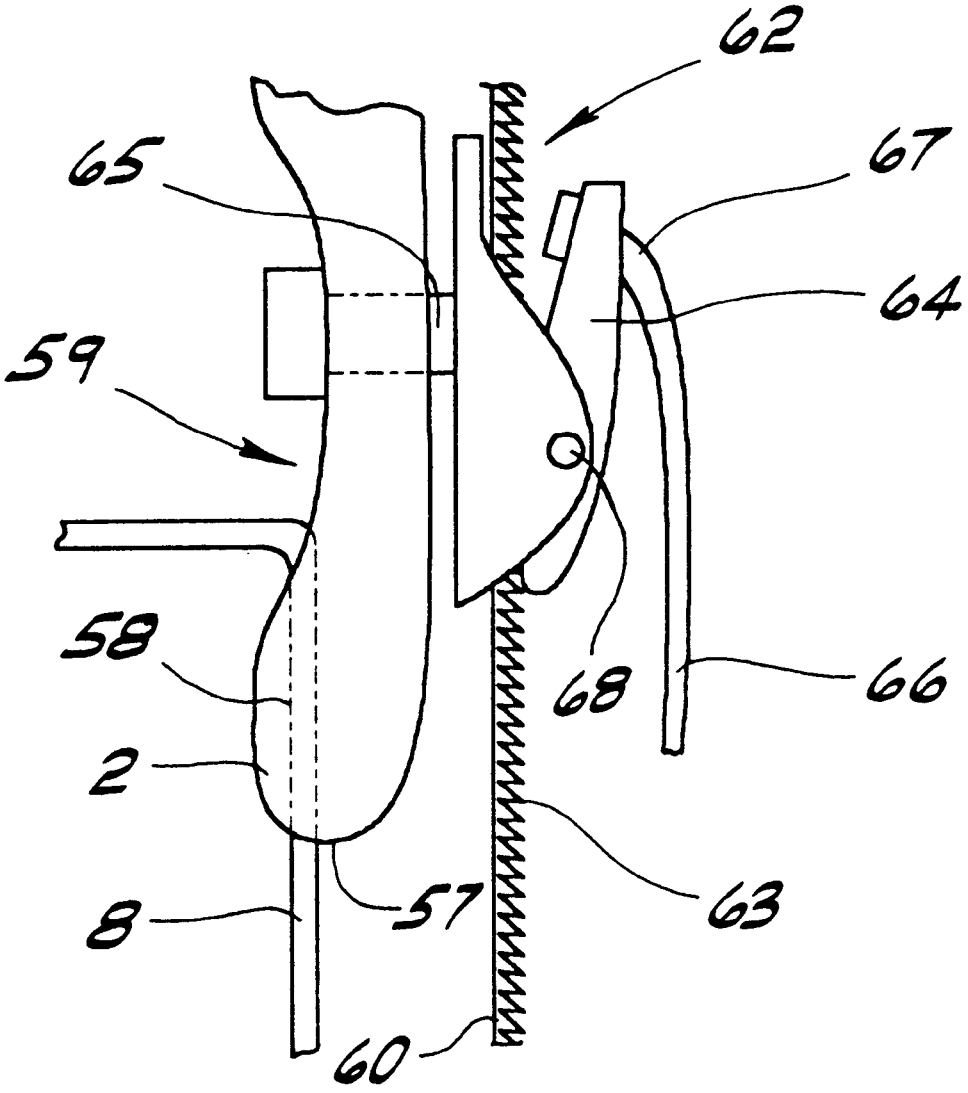
FIG. 10*b* shows the catch device of FIG. 10*a*.

FIGS. 10*a* and 10*b* show an embodiment of the snowboard binding in which the tensile element 8 is a cable with which the instep element 6 can be pivoted into the closed position. A first instep element 6 can be pivoted into the closed position. A first end 53 of the tensile element 8 is connected to one end 54 of a Velcro strip 55, which is fastened with an eyelet 56 to the instep element 6. The Velcro strip 55 serves as a length-adjustment device for the tensile element 8 and enables an adjustment of the closed position of the instep element 6. The tensile element 8 extends from the end 54 of the Velcro strip 55 to a front side 57 of the lateral side wall 2, which is best seen from the detail representation of FIG. 10*b*. In the lateral side wall 2 (FIG. 10*b*) a through-hole 58 is provided, which extends from the front side 57 up to a recess 59 on the inside of the lateral side wall 2, the tensile element 8 being led through the hole 58. The hole 58 thus serves as a "deflection element" for the tensile element 8. In the area of the recess 59, the tensile element 8 exits from the lateral side wall 2 and extends hanging freely downwards to the opposing lateral side wall 2', where it runs through a hole in the same manner and is joined to the instep element 6, which is not recognizable, however, in the representation shown.

The section of the tensile element 8 between the two lateral side walls 2 and 2' serves as a "tread element" and is pressed downwards by the boot heel when the binding is stepped into, whereby the instep element 6 is drawn backwards or downwards into its closed position.

In order to hold the instep element 6 in place in the closed position, a toothed belt is provided on both sides of the binding, of which in the representation shown only a toothed belt 60 can be recognized. The toothed belt 60 is fashioned via a joint 61 to the instep element 6 and connected to a catch device 62 that is articulated to the lateral side wall 2. The toothed belt 60 can be produced, for instance from plastic, and is sufficiently rigid that, upon closure of the instep element 6, it is pushed through the catch device 62 until the closed position is reached. The closed position of the instep element 6 is maintained by teeth 63 of the toothed belt 60 which are engaged with a spring-tensioned catch lever 64 (FIG. 10*b* ) of the catch device 62, the catch device 62 being connected via a turning knuckle 65 to the lateral side wall 2, which permits an unimpeded rotary motion when closing or opening the binding. In the end of the toothed belt 60 on the instep side here, a hole 60*a* is provided, through which the tensile element 8 extends to the inside of the toothed is belt 60 and runs along it there to the lateral side wall 2. The section of the tensile element 8 between the instep element 6 and the lateral side wall 2 is thus covered by the toothed belt 60 in both the opening position and the closed position of the binding.

To open the binding, a resilient opening belt 66 is provided, which extends over the instep element 6 and whose ends 67 are connected to catch levers 64 provided on the lateral side walls 2 and 2'. If the opening belt 66 is pulled, the catch lever 64 pivots forwards about its pivot axis 68, so that the toothed belt 60 can be pulled into the opening position of the binding shown in FIG. 10*a* by the instep element 6 upon pulling the boot out of the binding. It is assured by the elasticity of the opening belt 66 that it will be in contact with instep element 6 in both the opening position and the closed position.

The tensile element 7, which joins the instep element 6 in the toe area of the binding to the lateral side wall 2, is likewise a toothed belt here. In order to displace the instep element 6 in the toe area, a catch device 69 is provided, which guides and catches the tensile element 7. The tensile element 7 is connected via a turning knuckle 70 to the lateral side wall 2 and permits an unimpeded pivoting of the instep element 6 when opening or closing the binding. The catch element 69 can additionally be connected via a turning knuckle to the instep element 6.

Finally, it should be emphasized that the basic idea of constructing the tread element and the tensile element as a connected cable can also be applied in the other embodiments described here.

Figure 11:
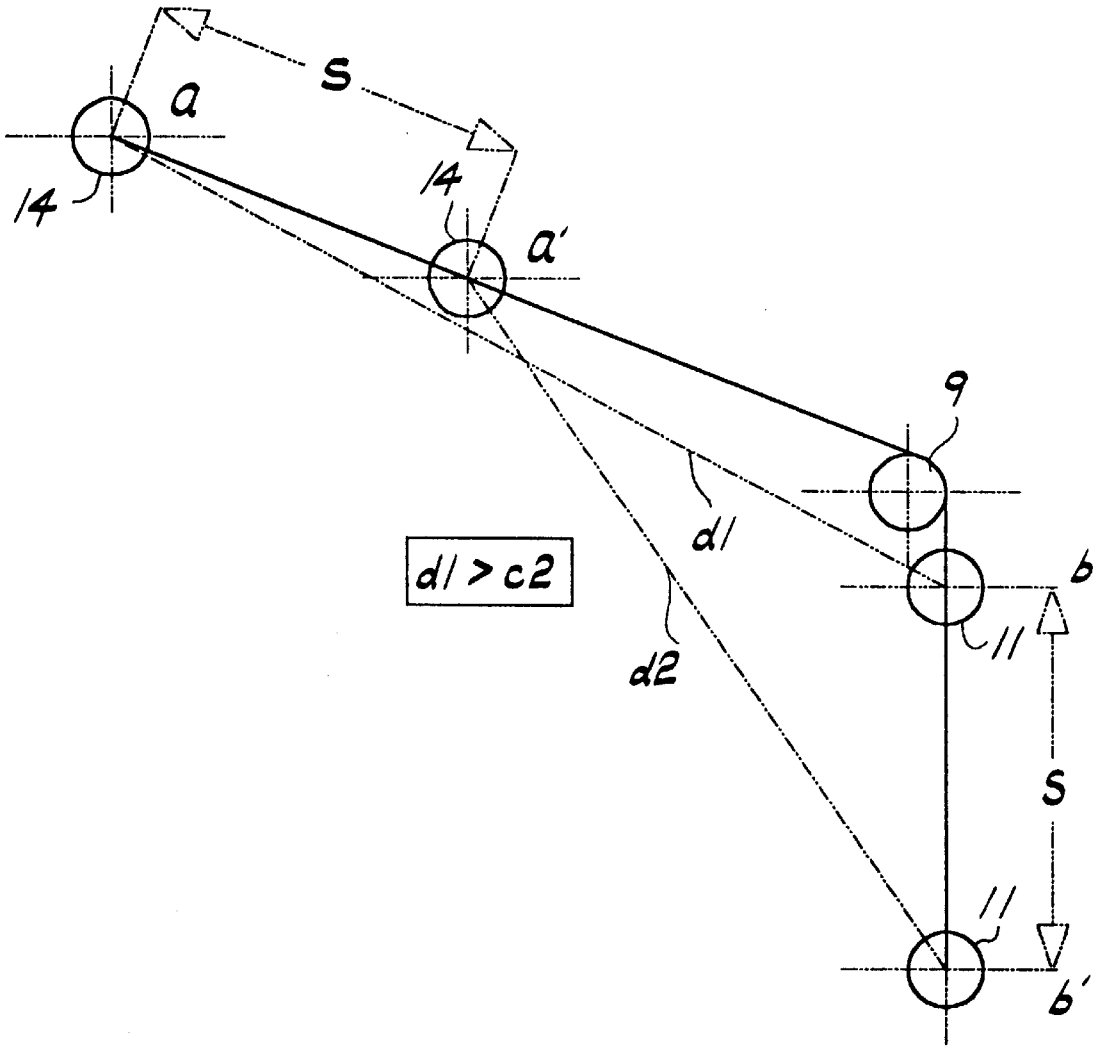
FIG. 11 a schematic sketch of the rear tensile element, the deflection element and the tread element in open and closed positions to illustrate the reduction of "opening width" when closing the binding.

FIG. 11 illustrates in a schematic sketch the reduction of the opening width of the binding upon closure. If the tread element 11 is moved from the opening position b into the closed position b', then the fastening element 14 is moved by the same distance from the opening position a into the closed position b', then the fastening element 14 is moved by the same distance from the opening position a into the closed position a'. The spacing between the tread element 11 and the instep element 6 is the distance d1 in the opening position and the distance d2 in the closed position. It is evident that the distance d1 is larger than the distance d2.

What is claimed is:

1. A snowboard binding for fastening a snowboard boot to a snowboard comprising:

a baseplate adapted to be mounted on the snowboard and having a heel portion projecting vertically upwardly along opposite sides of a longitudinal axis of the baseplate;

an instep element mounted over the baseplate and adapted to reach over the instep of said snowboard boot when said snowboard boot is positioned above the baseplate, a tread element movably mounted on the heel portion and extending transverse to the longitudinal axis of the baseplate, the tread element being selected from the group of elements consisting of a rod and a cable flexible tensile elements coupling the tread element to the instep element, the flexible tensile elements being mounted on respective sides of the instep element, the tread element being movable downwardly a displacement distance when the heel of the boot engages the tread element for moving the instep element into a closed position when the boot is fully received within the binding and deflection elements mounted on the heel portion and engaging each of said tensile elements, each of said deflection elements being positioned above the baseplate a distance at least as great as the displacement distance.

2. A snowboard binding according to claim 1 wherein each deflection element is formed by a respective hole provided in the side wall of the baseplate, and wherein the tensile elements are each guided from an outer portion of the associated side wall through the holes into an area between the side walls and connected therein to the tread element.

3. A snowboard binding according to claim 2 wherein the holes each extend from the front side of the side wall into a recess on the inside of the side wall.

4. A snowboard binding according to claim 1 wherein the tensile elements and the tread element are formed by a common cable whose ends are coupled to the instep element, and wherein the tread element is formed by a section of the cable lying between the side walls.

5. A snowboard binding according to claim 1 wherein the instep element is connected on both sides by toothed belts and associated spring-tensioned catch elements joined to the side walls.

6. A snowboard binding according to claim 5 wherein the spring-tensioned catch elements are connected together by an elastic opening element extending over the instep element, the opening element operable to move the toothed belts to an open position.

7. A snowboard binding according to claim 1 wherein the instep element covers the a portion of the front of the snowboard boot and substantially all of the instep area of the snowboard boot, the instep element being of one-piece construction and fastened with a total of four tensile elements to the side walls.

8. A snowboard binding according to claim 7 wherein two of the four tensile elements are joined to the forward end of the instep element and each of said two tensile elements include a toothed belt that is engaged in an associated catch element.

9. A snowboard binding according to claim 1 wherein the tread element is guided in a sliding guide on the side walls extending essentially perpendicular to the baseplate.

10. A snowboard binding according to claim 1 wherein the deflection element is arranged above the tread element.

11. A snowboard binding according to claim 1 wherein the deflection element can be displaced in a recess.

12. A snowboard binding according to claim 1 wherein the length of the tensile elements is adjustable.

13. A snowboard binding according to claim 12 further comprising a hook and loop fastener for adjusting the length of the tensile elements, the fastener being connected to one of the tensile elements and to a retaining loop mounted on the instep element.

14. A snowboard binding according to claim 12 further comprising threaded sleeves fastened to the ends of the tensile elements at the instep element, T-pieces with internal threading screwed onto the threaded sleeves, and at least one pair of hooks attached to the instep element on which a crossbar of the T-piece is supported.

15. A snowboard binding according to claim 1 wherein the displacement distance of the tread element is between 6 and 9 cm.

16. A snowboard binding according to claim 1 further comprising a spring-tensioned locking element that projects into the displacement path of the tread element and has a inclined edge on which the tread element slides and a locking surface on its bottom side for catching the tread element.

17. A snowboard binding according to claim 1 wherein the tensile element includes a thickened portion, the binding further comprising a spring-tensioned detent pawl engaging the thickened portion.

18. A snowboard binding according to claim 1 wherein the side walls are constructed with double walls.

19. A snowboard binding according to claim 1 further comprising a support element supporting at least the shank of the snowboard boot and pivotally mounted on a heel part of the snowboard binding about an axis transverse to the longitudinal direction of the snowboard binding.

20. A snowboard binding according to claim 19 wherein the support element is mounted so as to pivot on a free end of a retainer strap connected to the heel part, the retainer strap extending essentially perpendicular to the baseplate.

* * * * *